US012577708B2

(12) United States Patent
Pierce et al.

(10) Patent No.: US 12,577,708 B2
(45) Date of Patent: Mar. 17, 2026

(54) OUTDOOR FABRIC HAVING WOOL-LIKE PROPERTIES

(71) Applicant: Safety Components International, Inc., Greensboro, NC (US)

(72) Inventors: John Pierce, Greensboro, NC (US); Lon Beasley, Greensboro, NC (US)

(73) Assignee: Safety Components International, Inc., Greensboro, NC (US)

( * ) Notice: Subject to any disclaimer, the term of this patent is extended or adjusted under 35 U.S.C. 154(b) by 397 days.

(21) Appl. No.: 17/993,332

(22) Filed: Nov. 23, 2022

(65) Prior Publication Data

US 2023/0160109 A1 May 25, 2023

Related U.S. Application Data

(60) Provisional application No. 63/282,500, filed on Nov. 23, 2021.

(51) Int. Cl.

| | |
|---|---|
| ***D03D 1/00*** | (2006.01) |
| ***D03D 7/00*** | (2006.01) |
| ***D03D 15/283*** | (2021.01) |
| ***D03D 15/44*** | (2021.01) |
| ***D03D 15/50*** | (2021.01) |

(52) U.S. Cl.

CPC ..... *D03D 1/0017* (2013.01); *D03D 1/007* (2013.01); *D03D 7/00* (2013.01); *D03D 15/283* (2021.01); *D03D 15/44* (2021.01); *D03D 15/50* (2021.01); *D10B 2503/00* (2013.01)

(58) Field of Classification Search

CPC .... D03D 1/0017; D03D 1/007; D03D 15/283; D03D 15/50; D03D 15/44; D10B 2503/00

See application file for complete search history.

(56) References Cited

U.S. PATENT DOCUMENTS

| | | | | |
|---|---|---|---|---|
| 5,516,578 | A | 5/1996 | Coppens | |
| 6,192,520 | B1 | 2/2001 | Underwood et al. | |
| 7,581,260 | B2 | 9/2009 | Underwood et al. | |
| 8,296,974 | B2 | 10/2012 | Sonnenschein et al. | |
| 8,793,814 | B1 | 8/2014 | Dilanni et al. | |
| 8,969,492 | B2 | 3/2015 | Fuchs et al. | |
| 2006/0154542 | A1* | 7/2006 | Underwood | D06M 15/19 442/79 |
| 2006/0292323 | A1 | 12/2006 | Huthinson et al. | |
| 2007/0072502 | A1 | 3/2007 | Underwood et al. | |
| 2011/0165807 | A1 | 7/2011 | Underwood et al. | |
| 2013/0254980 | A1 | 10/2013 | Underwood et al. | |
| 2014/0127401 | A1 | 5/2014 | Underwood et al. | |
| 2015/0239007 | A1 | 8/2015 | Selwyn | |
| 2016/0090505 | A1 | 3/2016 | Sworen et al. | |
| 2016/0090560 | A1 | 3/2016 | Sworen et al. | |
| 2017/0030010 | A1 | 2/2017 | Baumann | |
| 2017/0073859 | A1 | 3/2017 | Cantin et al. | |

(Continued)

FOREIGN PATENT DOCUMENTS

WO WO 2018/031534 A1 2/2018

*Primary Examiner* — Camie S Thompson

(74) *Attorney, Agent, or Firm* — Dority & Manning, P.A.

(57) ABSTRACT

A weather-resistant fabric is disclosed made from highly texturized multifilament synthetic polymer yarns. The yarns have a relatively large size or denier and are woven in a manner that produces a fabric with wool-like characteristics. The weather-resistant fabric is particularly well suited as an upholstery fabric for outdoor furniture.

18 Claims, 2 Drawing Sheets

(56) References Cited

U.S. PATENT DOCUMENTS

| | | | | |
|---|---|---|---|---|
| 2017/0204558 | A1 | 7/2017 | Knaup | |
| 2017/0314189 | A1 | 11/2017 | Curran et al. | |
| 2018/0223458 | A1 | 8/2018 | Truesdale, III | |
| 2019/0242035 | A1* | 8/2019 | Pierce | D03D 1/00 |

* cited by examiner

OUTDOOR FABRIC HAVING WOOL-LIKE PROPERTIES

RELATED APPLICATIONS

The present application is based upon and claims priority to U.S. Provisional Patent Application Ser. No. 63/282,500, having a filing date of Nov. 23, 2021, and which is incorporated herein by reference.

BACKGROUND

Fabrics that are appropriate for use in outdoor applications must be durable and must be able to withstand weather conditions and other harsh conditions to which they are often subjected. In designing a fabric for use in outdoor applications, it is important to look at factors including hydrostatic pressure and UV resistance properties. In addition, factors such as appearance, breathability, dimensional stability, abrasion resistance, mark off resistance, and ease of fabrication are also very important. Environmental considerations are important as well.

In the past, the water resistant properties of fabrics used in outdoor applications were improved by laminating a fabric to a polymer film or coating the fabric with a polymer composition that forms a film over a surface of the fabric, which are referred to herein as "coated" fabrics. Although coated fabrics can be made with excellent waterproof properties, the coated fabrics present a number of drawbacks. For instance, coated fabrics are not breathable or have limited breathability. In addition, the polymer film present on one side of the fabric can cause water vapors to be trapped on the uncoated side of the fabric leading to the formation of mildew. Coated fabrics are usually heavy, lack certain aesthetic qualities, and can be very costly to produce.

In view of the above, non-coated fabrics have been produced in the past for outdoor applications. For instance, various non-coated fabrics are disclosed in United States Patent Publication No. 2006/0154542, United States Patent Publication No. 2007/0072502, United States Patent Publication No. 2011/0165807, United States Patent Publication No. 2014/0127401, United States Patent Publication No. 2017/0073859, and United States Patent Publication No. 2019/0242035, which are all incorporated herein by reference. The outdoor fabrics disclosed in the above applications have made great advances in the art and have proven to be weatherable and durable.

The present disclosure is directed to further improvements in fabrics for outdoor applications. More particularly, a need exists for an outdoor fabric having improved physical properties that makes the fabric well suited for use in producing outdoor furniture and other similar products. For example, a need exists for an outdoor weather-resistant fabric that can not only be made with various different patterns and designs but has a feel and drape that consumers desire.

SUMMARY

In general, the present disclosure is directed to a weather-resistant fabric that may be used in all different types of outdoor applications. The weather-resistant fabric of the present disclosure is breathable, water-resistant, and is fade-resistant. The weather-resistant fabric is produced from multifilament yarns that contain a thermoplastic synthetic polymer. In one embodiment, the multifilament yarns can be made from recycled polymers. In accordance with the present disclosure, the multifilament yarns are subjected to a texturizing process and woven together in a manner such that the fabric has wool-like properties. For example, the fabric can be constructed so as to look and feel like wool.

For example, in one embodiment, the present disclosure is directed to a weather-resistant fabric comprising warp yarns and fill yarns that are woven together. The fabric can have any suitable weave, such as a plain weave, twill weave, basket weave, ripstop weave, or the like. The warp yarns comprise air textured multifilament yarns. The multifilament warp yarns contain filaments comprising a synthetic thermoplastic polymer. The multifilament warp yarns can have a denier of from about 500 to about 1200, such as from about 850 to about 1150, such as from about 900 to about 1050. The multifilament warp yarns are solution dyed and contain a UV stabilizer.

Similarly, the fill yarns comprise air textured multifilament yarns. The multifilament fill yarns contain filaments comprising a synthetic thermoplastic polymer. The multifilament fill yarns can have a denier of from about 500 to about 1200, such as from about 850 to about 1150, such as from about 900 to about 1050. The multifilament fill yarns are solution dyed and contain a UV stabilizer.

The multifilament warp yarns and the multifilament fill yarns can be the same or different.

In accordance with the present disclosure, the multifilament yarns are air textured and have a size and are woven together that produces a fabric having a unique wool-like appearance and feel.

Due to incorporating solution dyed multifilament yarns into the weather-resistant fabric, in one embodiment, the fabric is not dyed, meaning that the fabric is not exposed to a dye once woven. Using solution dyed multifilament yarns provides enhanced fade resistance, even when exposed to the sun and outdoor environmental conditions. The weather-resistant fabric, in one embodiment, can have a basis weight of greater than about 9.5 osy, such as greater than about 10 osy, such as greater than about 10.5 osy, and generally less than about 12.5 osy, such as less than about 12 osy. The weather-resistant fabric, for instance, can contain from about 30 warp yarns to about 55 warp yarns per inch and can contain from about 25 fill yarns to about 50 fill yarns per inch. The weather-resistant fabric can be a single layer fabric that is non-coated and not laminated to other textile materials.

The weather-resistant fabric, however, can include a water-resistant finish that is impregnated into the fabric (as opposed to forming a coating). In one aspect, the water-resistant finish can be substantially fluorocarbon-free. For instance, the weather-resistant fabric can contain fluorine in an amount less than about 1,000 ppm, such as in an amount less than about 500 ppm, such as in an amount less than about 100 ppm, such as in an amount less than about 100 ppb.

In one embodiment, the water-resistant finish can contain a polyurethane polymer, an acrylic polymer, or mixtures thereof. In one embodiment, the water-resistant finish can contain a polyurethane polymer comprising an aliphatic polyester/ether polyurethane polymer. The water-resistant finish can also contain a second polyurethane polymer that can comprise a blocked isocyanate. The water-resistant finish can also contain various other components and adjuvants. For instance, the water-resistant finish can also contain a wax, such as a paraffin wax.

The weather-resistant fabric of the present disclosure can have a blend of properties well suited for use in outdoor applications. For instance, the fabric can display a hydrostatic pressure when tested according to AATCC 127 of at least about 5 cm, such as at least about 8 cm, such as at least about 10 cm, and generally less than about 20 cm. The fabric can also have excellent abrasion resistance and fade resistance showing no rub-off or crocking.

The weather-resistant fabric of the present disclosure can be used in diverse and numerous applications. In one embodiment, for instance, the weather-resistant fabric can be incorporated into an outdoor furniture product. For instance, the weather-resistant fabric can be upholstered to a frame or can be formed into a hollow enclosure for containing a cushion including pillows.

Other features and aspects of the present disclosure are discussed in greater detail below.

BRIEF DESCRIPTION OF THE DRAWINGS

A full and enabling disclosure of the present disclosure, including the best mode thereof to one of ordinary skill in the art, is set forth more particularly in the specification, including reference to the accompanying figures in which.

Figure 1:
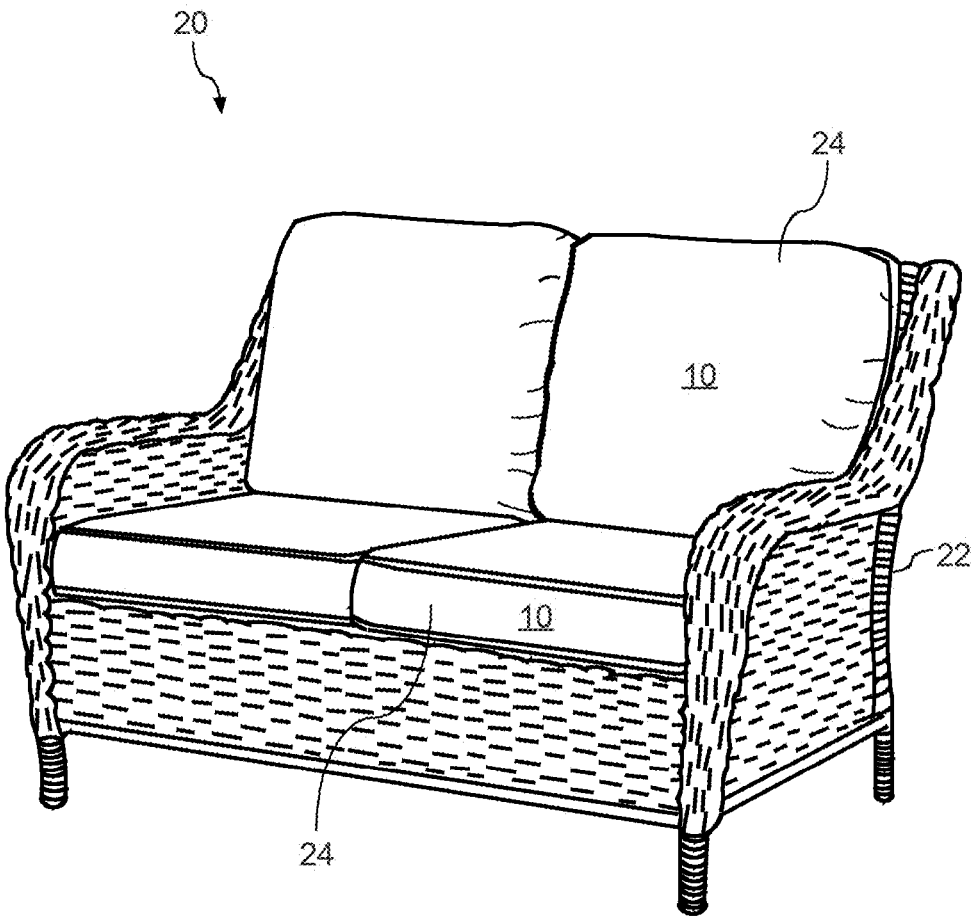
FIG. 1 is a perspective view of one embodiment of a furniture product made in accordance with the present disclosure.

Repeat use of reference characters in the present specification and drawings is intended to represent the same or analogous features or elements of the present invention.

Definitions and Standardized Procedures

The following definitions and procedures are offered in order to better describe and quantify the performance fabrics made according to the present disclosure.

Thickness Test

The thickness test measures the thickness of the fabric. The test is known in the art and conforms to ASTM D 1777-96 (Reapproved 2015). The results are expressed in millimeters.

A fabric is placed on the base of a thickness gage and a weighted presser foot is lowered. The displacement between the base and the presser foot is measured as the thickness of the fabric.

Water Repellency: Spray Rating Test

The spray rating test measures the resistance of fabrics to wetting by water. The test is known in the art and conforms to AATCC 22-2017. The results are expressed on a scale of 0 to 100 with 0 indicating a complete wetting of whole upper and lower surfaces and 100 indicating no sticking or wetting of the upper surface.

Water sprayed against the taut surface of a test specimen under controlled conditions produces a wetted pattern whose size depends on the relative repellency of the fabric. Evaluation is accomplished by comparing the wetted pattern with pictures on a standard chart.

Air Permeability

Air permeability can be used to provide an indication of the breathability of weather resistant and rainproof fabrics. The air permeability test is known in the art and conforms to ASTM D 737-2016. The results are expressed in cubic feet/square feet minute (cfm).

The rate of air flow passing perpendicularly through a known area of fabric is adjusted to obtain a prescribed air pressure differential between the two fabric surfaces. From this rate of air flow, the air permeability is determined.

Water Resistance: Hydrostatic Pressure Test

The hydrostatic pressure test measures the resistance of a fabric to the penetration of water under hydrostatic pressure. The test is known in the art and conforms to AATC 127-2017. The results are expressed in cm H2O.

One surface of the test specimen is subjected to a hydrostatic pressure, increasing at a constant rate, until three points of leakage appear on its other surface. The water may be applied from above or below the test specimen.

Stiffness of Fabric by the Circular Bend Procedure

The circular bend procedure gives a force value related to fabric stiffness, simultaneously averaging stiffness in all directions. The test is known in the art and conforms to ASTM D 4032-94 (Reapproved 2016).

A plunger forces a flat, folded swatch of fabric through an orifice in a platform. The maximum force required to push the fabric through the orifice is an indication of the fabric stiffness (resistance to bending).

Breaking Strength and Elongation of Textile Fabrics (Grab Test)

The grab tensile test used herein measures breaking strength of a fabric when subjected to unidirectional stress. This test is known in the art and conforms to ASTM D 5034-2017. The results are expressed in pounds to break. Higher numbers indicate a stronger fabric. The values noted herein, measured in pounds, represent the "load" or the maximum load or force, expressed in units of weight, required to break or rupture the specimen in a tensile test.

The grab tensile test uses two clamps, each having two jaws with each jaw having a facing in contact with the fabric sample. The clamps hold the fabric in the same plane, usually vertically, separated by approximately three inches and move apart at a specified rate of extension. The sample is wider than the clamp jaws to give results representative of effective strength of yarns in the clamped width combined with additional strength contributed by adjacent yarns in the fabric. Usually, a grab tensile strength test closely simulates fabric stress conditions in actual use. Results are reported as an average of three specimens and may be performed with the specimen in the cross direction or the machine direction.

Tearing Strength of Fabrics

Trap Tear strength is measured according to ASTM Test D 5587 (2019)

Abrasion Resistance of Textile Fabrics

Abrasion Resistance can be measured according to the Wyzenbeek method, which is ASTM Test D4157 (2017).

Ultraviolet Rating Test

Two methods are used to determine ultraviolet rating. The accelerated exposure test is designed to accelerate extreme environmental conditions encountered due to sunlight, heat, and moisture for the purpose of predicting the performance of materials. The colorfastness to light test tests the resistance of a material to a change in its color characteristics as a result of exposure of the material to sunlight or an artificial light source. The test methods used are known in the art and conform to AATC Test Method 169-2017 revision Xenon light and AATC Test Method 186-2015 revision Pure UV exposure.

Oil Repellency and Water Repellency

Oil repellency is measured according to AATCC Test Method 118-2013 and water repellency is measured according to AATCC Test Method 193-2017.

Burst Strength

The burst strength of a fabric also known as the "Diaphragm Burst" is tested in accordance with ASTM Test D3786-13. The results are measured in pounds. The test determines the diaphragm bursting strength of a fabric.

DETAILED DESCRIPTION

It is to be understood by one of ordinary skill in the art that the present discussion is a description of exemplary embodiments only, and is not intended as limiting the broader aspects of the present disclosure, which broader aspects are embodied in the exemplary construction.

The present disclosure is generally directed to a weather-resistant fabric that can be used in all different types of outdoor applications. The weather-resistant fabric, for instance, can be constructed to be durable, water and stain resistant, and abrasion resistant. The weather-resistant fabric can be made from multifilament yarns, such as multifilament polyester yarns or multifilament polyamide yarns. In one aspect, the yarns can be made from recycled fiber. In fact, in one embodiment, the yarns can be made from 100% recycled fiber. In accordance with the present disclosure, the multifilament yarns are subjected to a texturing treatment that causes the outer filaments of the yarn to form extensions which can be in the form of ring-like portions. Relatively large denier yarns are selected and the yarns are woven in a manner that produces a fabric not only with weather-resistant properties but also with a unique appearance and feel. For instance, although made from synthetic polymer yarns, the fabric can have a wool-like appearance and a wool-like feel. This is especially surprising in that the multifilament yarns are made with continuous filaments as opposed to staple fibers.

The use of multifilament yarns to construct the fabric of the present disclosure also can provide various other advantages and benefits in addition to the unique look and feel of the fabric. For instance, the multifilament yarns can significantly improve abrasion resistance. In addition, the multifilament yarns can make the fabric strong and tear resistant.

As described above, the multifilament yarns incorporated into the weather-resistant fabric of the present disclosure are textured. More particularly, the multifilament yarns can be air textured in a manner that causes the outer filaments of the multifilament yarn to form extensions that extend laterally from the primary direction of the yarn. In one aspect, the extensions can be in the form of ring-like portions or loops. The ring-like structures or loops formed on the exterior surface of the yarns can increase the bulk and loft of the fabric and can completely change the feel of the fabric such that the fabric has wool-like qualities.

During air jet texturing, the multifilament yarns are overfed at a constant rate to an air jet device. Overfed means that the speed of the yarn entering the process is faster than the speed of the yarn exiting the process and can be from about 0% (entering speed equal to exit speed) to about 120%. For instance, the yarn can be overfed at a rate that is greater than about 30%, such as greater than about 40%, such as greater than about 50%, such as greater than about 60%, such as greater than about 70%, such as greater than about 80%, such as greater than about 90%, such as greater than about 100%, such as greater than about 110%, and less than about 120%. During air jet texturing, a jet or jets of air are directed against the multifilament yarns, usually in the direction of travel, forming a turbulent region which causes the yarn to texturize and form the ring-like or loop structures on the surface. The air pressure during air texturing can be from about 10 psi to about 200 psi, such as from about 50 psi to about 200 psi, such as from about 80 psi to about 200 psi, such as from about 120 psi to about 200 psi.

During air texturing, a liquid, such as water, can be applied to the yarns prior to contact with the air in order to lubricate the yarns. In one aspect, the yarns can also be heated and drawn prior to contact with the air.

Any suitable air texturing device can be used to air texture the yarns. For example, in one aspect, the air jet system can include venturi-type air jets. Alternatively, the system can include vortex-type air jets. The air jets can operate at a pressure of generally greater than about 90 psi, such as greater than about 110 psi, such as greater than about 130 psi, and generally less than about 300 psi, such as less than about 200 psi, such as less than about 150 psi.

Although the air textured multifilament yarns can be used only in the warp direction or only in the fill direction, in one embodiment, the weather-resistant fabric of the present disclosure contains air textured multifilament yarns in both the warp direction and the fill direction.

In general, the multifilament yarns in the warp direction and the multifilament yarns in the fill direction can be identical yarns or can be different. For instance, the warp yarns and the fill yarns can have different deniers or can be made from different synthetic polymers. In one aspect, the multifilament yarns used as the warp yarns and the multifilament yarns used as the fill yarns can each have a denier of generally greater than about 500, such as greater than about 600, such as greater than about 700, such as greater than about 800, such as greater than about 850, such as greater than about 900. The denier of the multifilament warp yarns and the denier of the multifilament fill yarns can generally be less than about 1200, such as less than about 1150, such as less than about 1100, such as less than about 1050, such as less than about 1000. Each multifilament warp yarn and each multifilament fill yarn can generally contain greater than about 180 filaments per yarn, such as greater than about 200 filaments per yarn, such as greater than about 220 filaments per yarn, such as greater than about 240 filaments per yarn, and generally less than about 350 filaments per yarn, such as less than about 325 filaments per yarn, such as less than about 300 filaments per yarn, such as less than about 275 filaments per yarn, such as less than about 250 filaments per yarn. Although plied yarns can be used, in one embodiment, the multifilament warp yarns and the multifilament fill yarns are non-plied yarns. The denier per filament of the multifilament warp yarns and the multifilament fill yarns can generally be less than about 4, such as less than about 3, such as less than about 2.5, such as less than about 2, such as less than about 1.5, such as less than about 1, such as less than about 0.8, and generally greater than about 0.5, such as greater than about 1, such as greater than about 1.5, such as greater than about 2.

The multifilament warp yarns and the multifilament fill yarns can generally have a Leesona shrinkage percentage of less than about 7%, such as less than about 6%, such as less than about 5%, and generally greater than about 1%, such as greater than about 2%, such as greater than about 3%. The multifilament warp yarns and the multifilament fill yarns can have an elongation of generally greater than about 10%, such as greater than about 15%, such as greater than about 20%, and generally less than about 30%, such as less than about 28%, such as less than about 26%, such as less than about 24%. The multifilament warp yarns and the multifilament fill yarns can have a tenacity of greater than about 1.2 GPD, such as greater than about 1.7 GPD, such as greater than about 2 GPD, such as greater than about 2.3 GPD, such as greater than about 2.5 GPD. The tenacity is generally less than about 5 GPD, such as less than about 4.5 GPD, such as less than about 4 GPD, such as less than about 3.5 GPD, such as less than about 3 GPD. The multifilament warp yarns and the multifilament fill yarns can have a breaking strength of generally greater than about 1600 grams, such as greater than about 1800 grams, such as greater than about 2000 grams, and generally less than about 4000 grams, such as less than about 3000 grams.

In one embodiment, the multifilament warp yarns and the multifilament fill yarns are solution dyed yarns. Solution dyed yarns are yarns where the coloring agent is combined with the polymer in a molten state and then extruded into filaments. In this manner, the coloring agent, which can be a dye or pigment, is blended or mixed with the polymer within each of the filaments. The multifilament yarns can be solution dyed with a single coloring agent or with a combination of coloring agents. Further, all of the multifilament yarns contained within the weather-resistant fabric can display the same color for displaying a particular shade of that color or can display multiple colors for creating fabrics with different visual patterns.

There are many benefits and advantages to using solution dyed multifilament yarns. Solution dyed yarns, for instance, are weather resistant and do not fade. In addition, since the color is co-mingled with the polymer, the coloring agents do not wear off, rub off, or undergo crocking. In one embodiment, for instance, the weather-resistant fabric contains solution dyed multifilament yarns and is otherwise not dyed or treated with a coloring agent. For instance, once the fabric is woven, in one embodiment, the fabric is not contacted or treated with a dye such as by being fed through a dye bath.

In addition to containing one or more coloring agents, the filaments contained in the multifilament yarns can also include one or more ultraviolet light stabilizers. The one or more ultraviolet light stabilizers can be combined with the synthetic polymer in a molten state prior to forming the multifilament yarns. Thus, like one or more coloring agents, the ultraviolet light stabilizers can be co-mingled with the polymer material.

Ultraviolet light stabilizers that may be incorporated into the yarns include benzotriazoles and/or triazines. Examples of triazines that can be incorporated into the yarns include, for instance, hydroxyphenyl triazine and/or a 2-hydroxyphenyl-s-triazine derivative.

Alternatively, the ultraviolet light stabilizer may comprise a benzophenone, a benzotriazole, or a benzoate. Particular examples of ultraviolet light stabilizers include 2,4-dihydroxy benzophenone, 2-hydroxy-4-methoxybenzophenone, 2-(2'-hydroxy-3',5'-di-t-butylphenyl)benzotriazole, 2-(2'-hydroxy-3'-t-butyl-5'-methylphenyl)-5-chlorobenzotriazole, 2,4-dihydroxybenzophenone, 2-hydroxy-4-methoxybenzophenone, 2-hydroxy-4-octoxybenzophenone, and 5,5'-methylene bis(2-hydroxy-4-methoxybenzophenone); 2-(2H-benzotriazole-2-yl)-4,6-bis(1-methyl-1-phenylethyl) phenol; 2-(2'-hydroxyphenyl)benzotriazoles, e.g., 2-(2'-hydroxy-5'-methylphenyl)benzotriazole, 2-(2'-hydroxy-5'-t-octylphenyl)benzotriazole, 2-(2'-hydroxy-3', 5'-di-t-butylphenyl) benzotriazole, 2-(2'-hydroxy-3',5'-di-t-butylphenyl)-5-chlorobenzotriazole, 2-(2'-hydroxy-3'-t-butyl-5'-methylphenyl)-5-chlorobenzotriazole, 2-(2'-hydroxy-3',5'-dicumylphenyl)benzotriazole, and 2,2'-methylene bis(4-t-octyl-6-benzotriazolyl) phenol, phenylsalicylate, resorcinol monobenzoate, 2,4-di-t-butylphenyl-3',5'-di-t-butyl-4'-hydroxybenzoate, and hexadecyl-3,5-di-t-butyl-4-hydroxybenzoate; substituted oxanilides, e.g., 2-ethyl-2'-ethoxyoxanilide and 2-ethoxy-4'-dodecyloxanilide; cyanoacrylates, e.g., ethyl-.alpha.-cyano-.beta.,.beta.-diphenylacrylate and methyl-2-cyano-3-methyl-3-(p-methoxyphenyl) acrylate or mixtures thereof. The UV light absorber, when present, can be present in the polymer filaments in an amount ranging from about 0.01% by weight to about 2% by weight, such as in an amount ranging from about 0.1% by weight to about 1% by weight based on the total weight of the filament.

Solution dyed yarns enhanced with UV stabilizers can greatly improve UV resistance. For example, the UV rating of the fabrics is at least 500 hours. In some embodiments, the UV rating of the fabrics is from about 500 hours to about 1500 hours. In some embodiments, the UV rating of the fabrics is at least 800 hours. In still other embodiments, the UV rating of the fabrics is at least 1000 hours. In some embodiments, the UV rating of the fabrics is from about 800 hours to about 1500 hours. In some embodiments, the UV rating of the fabrics is from about 1000 hours to about 1200 hours. High UV resistance characteristics in fabrics can increase color and strength retention.

The yarns used in the fabric of the present disclosure may be woven into various constructions. A particular weave may be selected to provide durability, breathability, and ease of fabrication. Any suitable weave can be used to construct the fabric, such as a plain weave, a twill weave, a rip stop weave, a herringbone weave, or the like. In accordance with the present disclosure, the amount of air texturing of the yarns in combination with the size of the yarns and the weave can all be selected so as to produce a fabric having wool-like characteristics, feel, and appearance.

The weight of the fabric made in accordance with the present disclosure can vary and generally will depend upon the particular application for which the fabric is used. The fabric is designed to withstand inconsistent and repetitive loads with high dynamic forces, heavy rain, air pressure, and the like. In general, the fabric can have a basis weight of from about 6 osy to about 20 osy. The basis weight of the weather-resistant fabric, for instance, can generally be greater than about 7 osy, such as greater than about 7.5 osy, such as greater than about 8 osy, such as greater than about 8.5 osy, such as greater than about 9 osy, such as greater than about 9.5 osy. The basis weight can be less than about 15 osy, such as less than about 13 osy, such as less than about 12.5 osy, such as less than about 12 osy, such as less than about 11.5 osy, such as less than about 11 osy.

As described above, the multifilament yarns used to produce the fabric are generally made from a thermoplastic synthetic polymer. For instance, the yarns can be made from a polyamide polymer, a polyester polymer, a polypropylene polymer, a polyethylene polymer, or mixtures thereof. In one embodiment, the fabric is made from polyester yarns. In one embodiment, the multifilament yarns can be made from recycled polymers, such as recycled fibers. In one particular embodiment, for instance, the yarns are made exclusively from recycled fibers, thus reducing environmental impact and increasing sustainability.

In addition to various other parameters, the yarn density of the fabric made in accordance with the present disclosure can also vary depending upon numerous factors. The yarn density in the warp direction, for instance, can generally be greater than about 30 yarns per inch, such as greater than about 33 yarns per inch, such as greater than about 35 yarns per inch, such as greater than about 38 yarns per inch. The yarn density in the warp direction is generally less than about 55 yarns per inch, such as less than about 50 yarns per inch. In the fill direction, the yarn density is generally greater than about 25 yarns per inch, such as greater than about 30 yarns per inch, such as greater than about 33 yarns per inch, such as greater than about 35 yarns per inch. The yarn density in the fill direction is generally less than about 50 yarns per inch, such as less than about 45 yarns per inch, such as less than about 40 yarns per inch.

In one embodiment, the fabric can be treated with a chemical composition or finish, such as a composition that improves the water resistant properties of the fabric. In accordance with the present disclosure, the water resistant finish is impregnated into the yarns and does not form a film over a surface of the fabric. Thus, the fabric can be treated with a water resistant finish in accordance with the present disclosure while still remaining a non-coated fabric. In this manner, the fabric can have excellent water resistant properties while still remaining breathable. The water resistant finish can also improve the abrasion resistant properties of the fabric.

In one aspect, the durable water-resistant finish can be substantially fluorocarbon-free or completely fluorocarbon-free. For example, after being treated with the water-resistant finish, the weather-resistant fabric of the present disclosure can contain fluorine in an amount less than about 1,000 ppm, such as in an amount less than about 800 ppm, such as in an amount less than about 600 ppm, such as in an amount less than about 400 ppm, such as in an amount less than about 300 ppm, such as in an amount less than about 200 ppm, such as in an amount less than about 100 ppm. In one aspect, the weather-resistant fabric contains fluorine in an amount less than about 500 ppb, such as less than about 300 ppb, such as less than about 200 ppb, such as less than about 100 ppb.

The water-resistant finish can, in one embodiment, contain a polyurethane polymer. In an alternative embodiment, the durable water-resistant finish can contain an acrylic polymer. In still another embodiment, the durable water-resistant finish can contain a polyurethane polymer in combination with an acrylic polymer.

In one aspect, the fluorocarbon free durable water-resistant finish contains a binder and/or an extender combined with various other ingredients and components. For instance, the durable water-resistant finish can also include a softener, a repelling agent, or both a softener and a repelling agent.

The binder contained in the durable water-resistant finish, in one embodiment, can comprise a polyurethane polymer. Of particular advantage, the polyurethane polymer can be water-based and thus can be applied to the fabric in an aqueous dispersion. In one embodiment, the polyurethane polymer is an anionic polyurethane. The polyurethane polymer can also be an aliphatic polyurethane. In one particular embodiment, the polyurethane polymer that makes up the binder is a polyester/ether polyurethane polymer, such as an aliphatic polyester/ether polyurethane polymer.

Optionally, the above binder can be combined with an extender. The extender may also comprise a polyurethane polymer. Thus, in one embodiment, the durable water-resistant finish includes a first polyurethane polymer combined with a second polyurethane polymer. The extender, for instance, can comprise a modified polyurethane polymer. For instance, the extender may be a blocked isocyanate, such as an oxime-blocked isocyanate. The extender can be cationic or nonionic. The extender is for further increasing water and oil resistance.

In addition to a binder and/or an extender, in one embodiment, the durable water-resistant finish can further include a softener. The softener, for instance, may comprise an emulsion of a polyalkylene polymer. The softener is generally nonionic. In one embodiment, the softener is a polyethylene polymer, such as a lower molecular weight polyethylene polymer.

In one embodiment, the durable water-resistant finish may also contain a repelling agent. The repelling agent may include an acrylic polymer alone or in combination with a wax, such as a paraffin wax. In one embodiment, the repelling agent may include a polyacrylate that also serves as a binder.

Each of the above ingredients can be combined with water and optionally a wetting agent, such as isopropyl alcohol for application to a fabric. The relative amounts of each component can vary depending on the particular formulation. In one embodiment, for instance, the binder or first polyurethane can be present in relation to the extender or second polyurethane in a weight ratio of from about 5:1 to about 1:2, such as in a weight ratio of from about 4:1 to 1:1. In one embodiment, the binder and extender are present in a weight ratio of from about 3:1 to about 1.5:1 based on the dried weight of the finish. The repelling agent can be present in amounts greater than the binder or the extender. For instance, the weight ratio (based on the dried weight of the finish) between the binder or extender and the repelling agent can be from about 3:1 to about 1:8, such as from about 1:1 to about 1:5, such as from about 1:1.5 to about 1:3.

When included in the formulation, the softener can generally be present in amounts less than the binder, the repelling agent or the extender. For example, in one embodiment, the softener can be present in relation to the binder in a weight ratio of from about 1:1 to about 1:4, such as from about 1:1.5 to about 1:3.

Prior to applying the water-resistant finish, the fabric is first woven with a desired construction and weight. Prior to applying the durable water resistant finish, the fabric can be first scoured, although scouring may not be necessary for all applications. When scoured, the material can be scoured with an alkaline solution.

After being scoured, the fabric is then put on a tenter frame, dried and heat set. For instance, after scouring, the fabric should be dried so that the moisture level is substantially equivalent to the natural moisture level of the fibers used to make the fabric. For instance, for most fibers, the moisture level should be less than about 10%, and particularly less than about 7%.

After the fabric has been dried and heat set, a durable water resistant finish according to the present disclosure is applied to at least one side of the fabric. Although the finish can be sprayed on the fabric or printed on the fabric, preferably the fabric is dipped into a bath containing the durable water resistant finish in dispersion form.

The amount of the water-resistant finish applied to the fabric will depend upon the particular formulation and the particular application.

After the durable water resistant finish is applied to the fabric, the fabric is then heated to a temperature sufficient for the coating to dry and/or cure. Once the durable water resistant finish is cured and affixed to the fabric, the fabric can then be used in constructing outdoor furniture products in accordance with the present disclosure.

In one aspect, the dried finish can contain the binder in an amount greater than about 10% by weight, such as in an amount greater than about 15% by weight, such as in an amount greater than about 20% by weight, and generally in an amount less than about 50% by weight, such as in an amount less than about 40% by weight, such as in an amount less than about 30% by weight. The extender can be present in the dried finish in an amount greater than about 5% by weight, such as in an amount greater than about 8% by weight, such as in an amount greater than about 10% by weight, and generally in an amount less than about 30% by weight, such as in an amount less than about 25% by weight, such as in an amount less than about 20% by weight. The repelling agent can be present in the dried durable water resistant finish in an amount greater than about 10% by weight, such as in an amount greater than about 20% by weight, such as in an amount greater than about 25% by weight, such as in an amount greater than about 35% by weight and generally in an amount less than about 70% by weight, such as in an amount less than about 65% by weight, such as in an amount less than about 55% by weight. When a softener is present, the softener can be present in the dried finish in an amount greater than about 5% by weight, such as in an amount greater than about 10% by weight, and generally in an amount less than about 25% by weight, such as in an amount less than about 20% by weight, such as in an amount less than about 15% by weight based upon the weight of the dried water resistant finish.

The weather-resistant fabric made in accordance with the present disclosure can have a unique combination of properties that makes the fabric well suited for use in outdoor applications. For instance, the fabric can have a spray rating when tested according to AATCC Test 22 of at least 90, such as at least 95, such as even a rating of 100. The outdoor cover product or fabric can display a hydrostatic pressure when tested according to AATCC Test 127 of at least 5 cm, such as at least 7 cm, such as at least 8 cm, such as at least 10 cm, such as at least 11 cm. The hydrostatic pressure is generally less than about 25 cm.

The weather-resistant fabric can also have excellent air permeability properties. For instance, the fabric, when tested according to ASTM Test D737 at 125 pascals, can have an air permeability of greater than about 50 cfm, such as greater than about 60 cfm, such as greater than about 70 cfm. The air permeability is generally less than about 100 cfm.

Preferred embodiments of the present disclosure involve the use of the fabric in the construction of materials for outdoor applications. Items that benefit from improved hydrostatic pressure and UV resistance may be constructed from the fabric described herein. For example, casual outdoor furniture, outdoor cushions and pillows, umbrellas, covers, canopies, or seat covers, and the like may be constructed using the fabric of the present disclosure.

Figure 2:
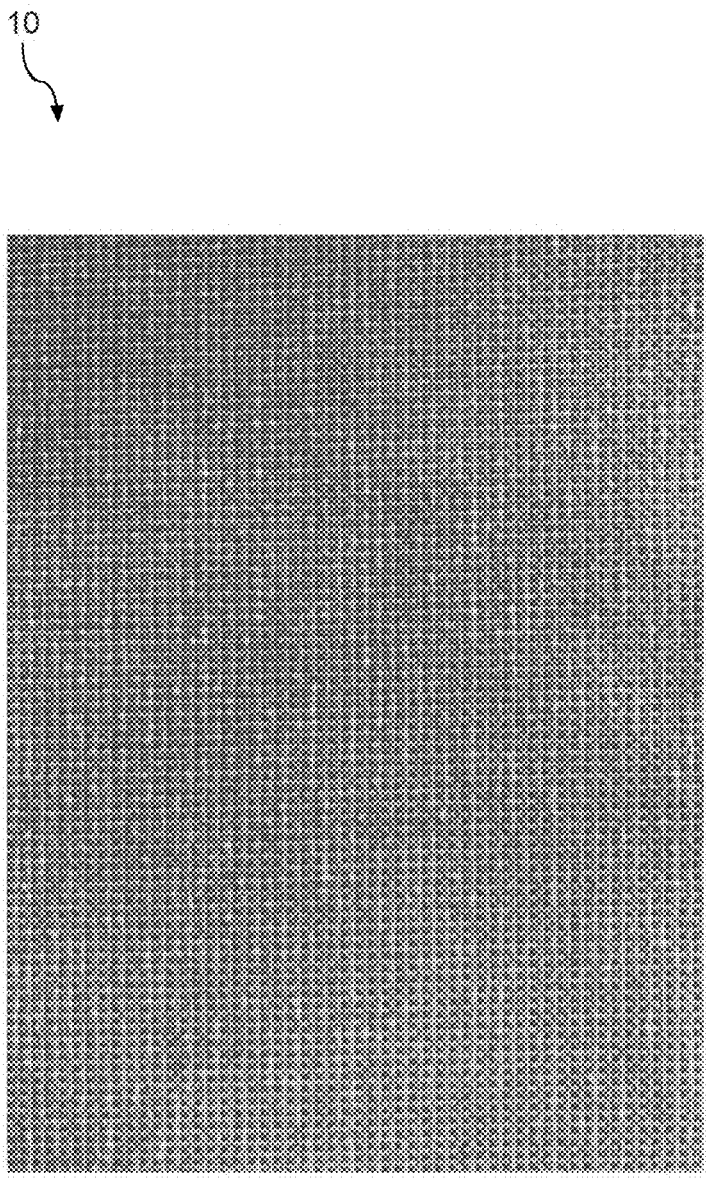
FIG. 2 is a plan view of one embodiment of a weather-resistant fabric made in accordance with the present disclosure.

For exemplary purposes only, one embodiment of a weather-resistant fabric 10 made in accordance with the present disclosure is shown in FIG. 2. As shown, the weave of the fabric 10, in this embodiment, produces a visible grid-like pattern. In between the grids appear to be tufts of fibers which are created when using the air texturized multifilament yarns. The tufts of fibers are the extensions produced on the outside surface of the yarns. These tufts not only provide the fabric 10 with a wool-like appearance but also give the fabric 10 a wool-like feel.

The weather-resistant fabric 10 can be used in numerous and diverse applications. In one embodiment, the fabric can be part of an outdoor furniture product 20 as shown in FIG. 1. The outdoor furniture product 20, for instance, can be chair, a couch, or a loveseat. The outdoor furniture product 20 includes a frame or structure 22 that is designed to support a plurality of cushions 24. In accordance with the present disclosure, the cushions 24 can be covered with the weather-resistant fabric 10 of the present disclosure. For instance, the weather-resistant fabric 10 can be formed into the shape of a hollow enclosure that is designed to receive a cushion or resilient material for producing the cushions 24.

These and other modifications and variations to the present disclosure may be practiced by those of ordinary skill in the art, without departing from the spirit and scope of the present disclosure, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the disclosure so further described in such appended claims.

What is claimed:

1. An outdoor furniture product comprising:

a weather-resistant fabric, the weather-resistant fabric being impregnated with a water-resistant finish and containing fluorine in an amount less than 1,000 ppm, the weather-resistant fabric comprising warp yarns and fill yarns woven together, the warp yarns comprising air textured multifilament yarns, the air textured multifilament warp yarns containing filaments comprising a synthetic thermoplastic polymer, the multifilament warp yarns having a denier of from about 500 to about 1200, the multifilament warp yarns being solution dyed and containing a UV stabilizer, the fill yarns comprising air textured multifilament yarns, the air textured multifilament fill yarns containing filaments comprising a synthetic thermoplastic polymer, the multifilament fill yarns having a denier of from about 500 to about 1200, the multifilament fill yarns being solution dyed and containing a UV stabilizer, the weather-resistant fabric having a basis weight of from about 7 osy to about 15 osy.

2. An outdoor furniture product as defined in claim 1, wherein the weather-resistant fabric has a basis weight of from about 9.5 osy to about 12.5 osy.

3. An outdoor furniture product as defined in claim 1, wherein the multifilament warp yarns and the multifilament fill yarns have a denier of from about 850 to about 1,150.

4. An outdoor furniture product as defined in claim 1, wherein the multifilament warp yarns and the multifilament fill yarns contain from about 180 to about 350 filaments per yarn.

5. An outdoor furniture product as defined in claim 1, wherein the multifilament warp yarns are the same as the multifilament fill yarns.

6. An outdoor furniture product as defined in claim 1, wherein the weather-resistant fabric is not exposed to a dye once woven.

7. An outdoor furniture product as defined in claim 1, wherein the weather-resistant fabric contains from about 30 warp yarns to about 55 warp yarns per inch and contains from about 25 fill yarns to about 50 fill yarns per inch.

8. An outdoor furniture product as defined in claim 1, wherein the weather-resistant fabric is a single ply fabric that is non-coated.

9. An outdoor furniture product as defined in claim 1, wherein the weather-resistant fabric has a hydrostatic pressure when tested according to AATCC 127 of at least 5 cm.

10. An outdoor furniture product as defined in claim 1, wherein the water-resistant finish comprises a polyurethane polymer.

11. An outdoor furniture product as defined in claim 1, wherein the polyurethane polymer comprises an aliphatic polyester/ether polyurethane polymer and wherein the water-resistant finish contains a second polyurethane polymer, the second polyurethane polymer comprising a blocked isocyanate.

12. An outdoor furniture product as defined in claim 1, wherein the water-resistant finish contains an acrylic polymer.

13. An outdoor furniture product as defined in claim 1, wherein the water-resistant finish contains a wax.

14. An outdoor furniture product as defined in claim 1, wherein the multifilament warp yarns and the multifilament fill yarns both comprise polyester filaments.

15. An outdoor fabric product comprising:

a weather-resistant fabric, the weather-resistant fabric being impregnated with a water-resistant finish and containing fluorine in an amount less than 1,000 ppm, the weather-resistant fabric comprising warp yarns and fill yarns woven together, the warp yarns comprising air textured multifilament yarns, the air textured multifilament warp yarns containing filaments comprising a synthetic thermoplastic polymer, the multifilament warp yarns having a denier of from about 500 to about 1200, the multifilament warp yarns being solution dyed and containing a UV stabilizer, the fill yarns comprising air textured multifilament yarns, the air textured multifilament fill yarns containing filaments comprising a synthetic thermoplastic polymer, the multifilament fill yarns having a denier of from about 500 to about 1200, the multifilament fill yarns being solution dyed and containing a UV stabilizer, the weather-resistant fabric having a basis weight of from about 7 osy to about 15 osy.

16. A weather-resistant fabric as defined in claim 15, wherein the weather-resistant fabric has a basis weight of from about 9.5 osy to about 12.5 osy, wherein the multifilament warp yarns and the multifilament fill yarns have a denier of from about 850 to about 1,150, and wherein the multifilament warp yarns and the multifilament fill yarns contain from about 180 to about 350 filaments per yarn.

17. A weather-resistant fabric as defined in claim 15, wherein the weather-resistant fabric is not exposed to a dye once woven.

18. A weather-resistant fabric as defined in claim 15, wherein the weather-resistant fabric contains from about 30 warp yarns to about 55 warp yarns per inch and contains from about 25 fill yarns to about 50 fill yarns per inch.

* * * * *